US007651343B2

(12) United States Patent
Zhu et al.

(10) Patent No.: US 7,651,343 B2
(45) Date of Patent: Jan. 26, 2010

(54) LOW PROFILE ELECTRICAL CONNECTOR

(75) Inventors: Hui Zhu, ShenZhen (CN); Wei Yuan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,974

(22) Filed: Aug. 18, 2008

(65) Prior Publication Data

US 2009/0047832 A1 Feb. 19, 2009

(30) Foreign Application Priority Data

Aug. 17, 2007 (CN) ..... 2007 2 0042938 U

(51) Int. Cl.
*H01R 1/00* (2006.01)

(52) U.S. Cl. ..... 439/79; 439/569

(58) Field of Classification Search ..... 439/79, 439/569, 571

See application file for complete search history.

(56) References Cited

U.S. PATENT DOCUMENTS

| | | | | |
|---|---|---|---|---|
| 4,708,415 | A * | 11/1987 | White | 439/633 |
| 4,717,218 | A * | 1/1988 | Ratcliff | 439/59 |
| 4,734,042 | A * | 3/1988 | Martens et al. | 439/62 |
| 5,281,165 | A * | 1/1994 | McCleerey et al. | 439/510 |
| 5,855,484 | A * | 1/1999 | Hennessey et al. | 439/79 |
| 6,095,865 | A * | 8/2000 | Wu | 439/607 |
| 6,190,183 | B1 * | 2/2001 | Yang et al. | 439/79 |
| 6,478,603 | B1 * | 11/2002 | Wu | 439/378 |
| 6,699,070 | B1 * | 3/2004 | Wu | 439/574 |
| 7,182,610 | B2 * | 2/2007 | Lin | 439/79 |
| 7,517,232 | B2 * | 4/2009 | Yuan et al. | 439/79 |
| 2003/0096517 | A1 | 5/2003 | Ho | |
| 2004/0175969 | A1 * | 9/2004 | Maruyama et al. | 439/79 |
| 2004/0266229 | A1 * | 12/2004 | Li | 439/79 |

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector comprises an insulative housing and a plurality of terminals received in the insulative housing. The insulative housing has a mating portion, and the mating portion defines a plurality of receiving slots, an inserting slot communicating with the plurality of receiving slots and a pair of guiding posts respectively and symmetrically disposed at two sides of the inserting slot. The pair of guiding posts locating within the spectrum of the height of the inserting slot.

12 Claims, 4 Drawing Sheets

LOW PROFILE ELECTRICAL CONNECTOR

BACKGROUND OF THE INVENTION

1. Field of the Invention

The present invention relates to an electrical connector, and particularly to an electrical connector adapted for mounting on a print circuit board.

2. Description of the Related Art

With the rapid development of the technology of wireless communication and advanced technology of electrics, electrical connectors are designed to establish an electrical connection between a storage device and a print circuit board for high-speed signal transmission.

Usually, these electrical connectors are mounted on a print circuit board or terminated with cable. Please referring to US 2003/0096517 A1, Ho discloses an electrical connector 1, comprising an insulative housing 11 and a plurality of terminals 12 received in the insulative housing 11. The insulative housing 11 is elongated and comprises a plurality of receiving slots 117 for receiving the terminals 12 and a mating port 115 engaging with complementary connector. The insulative housing 11 defines a front face 1101, a rear face 1102 opposite to the front face 1101 and a pair of side walls 1104, 1105 adjoining the front face 1101 and the rear face 1102. The side walls 1104, 1105 respectively defines a guiding post at the middle portion thereof. The height of each guiding post is about equal to that of the side wall. Accordingly, the complementary connector defines a guiding slot cooperating with the guiding post. However, electrical connector accommodated in this electronic device should be with compact structure to comply with the miniature trend. Due to the position and the height of the pair guiding posts, the height of the guiding slot of the complementary should be increased to make sure the tongue plate and guiding slot are respectively corresponding to the mating port and the guiding posts of the electrical connector 1. Therefore, this design is adverse to reduce the total height of the electrical connector and its complementary connector, and also increase the total cost.

Hence, an improved electrical connector is desired to overcome the disadvantages of the prior art.

BRIEF SUMMARY OF THE INVENTION

Therefore, a main object of the present invention is to provide an electrical connector with low profile.

To fulfill the above-mentioned object, an electrical connector comprises an insulative housing and a plurality of terminals received in the insulative housing. The insulative housing has a mating portion, and the mating portion defines a plurality of receiving slots, an inserting slot communicating with the plurality of receiving slots and a pair of guiding posts respectively and symmetrically disposed at two sides of the inserting slot. The pair of guiding posts locating within the spectrum of the height of the inserting slot.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
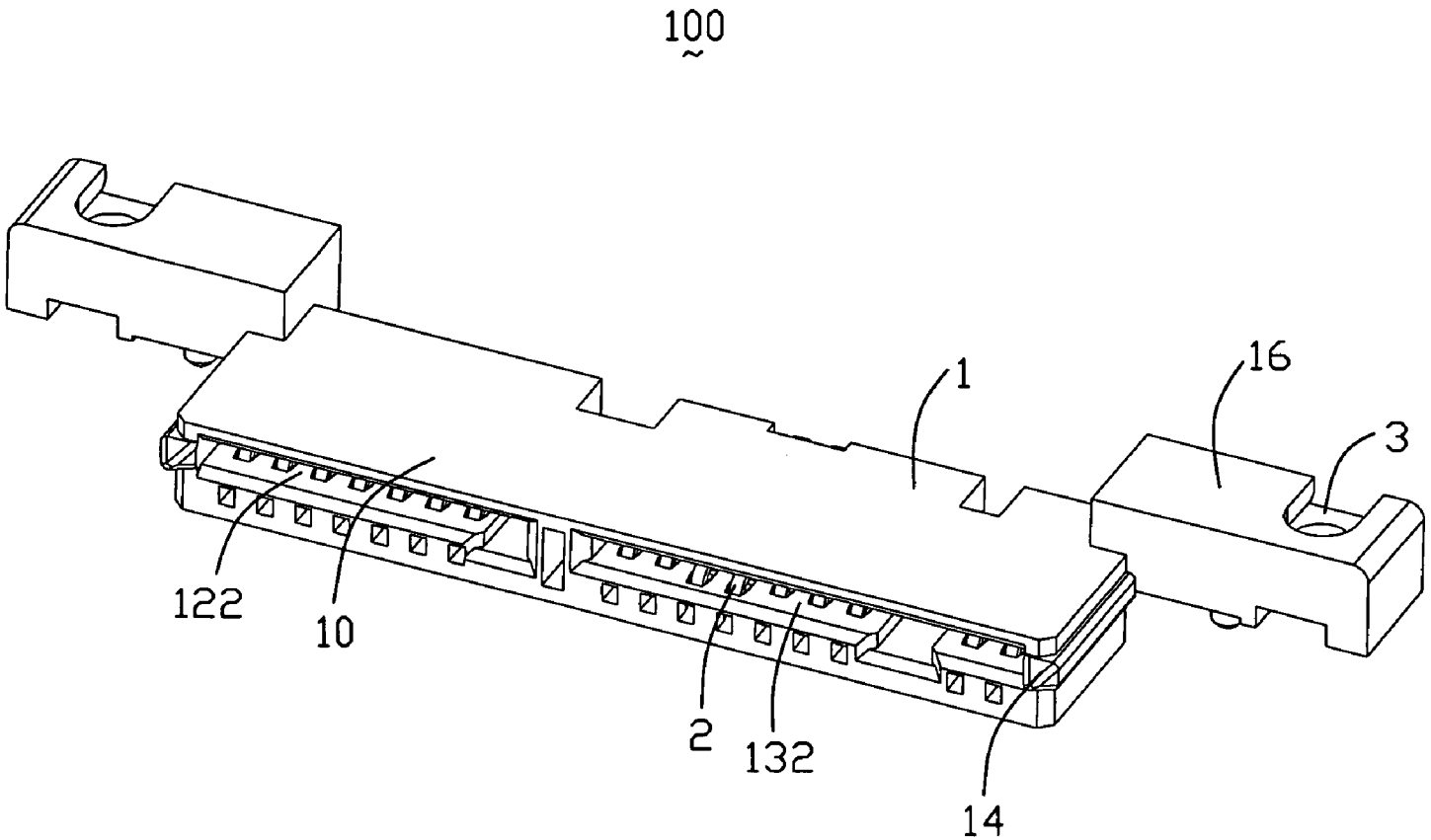
FIG. 1 is an assembled, perspective view of an electrical connector according to the present invention.
Figure 2:
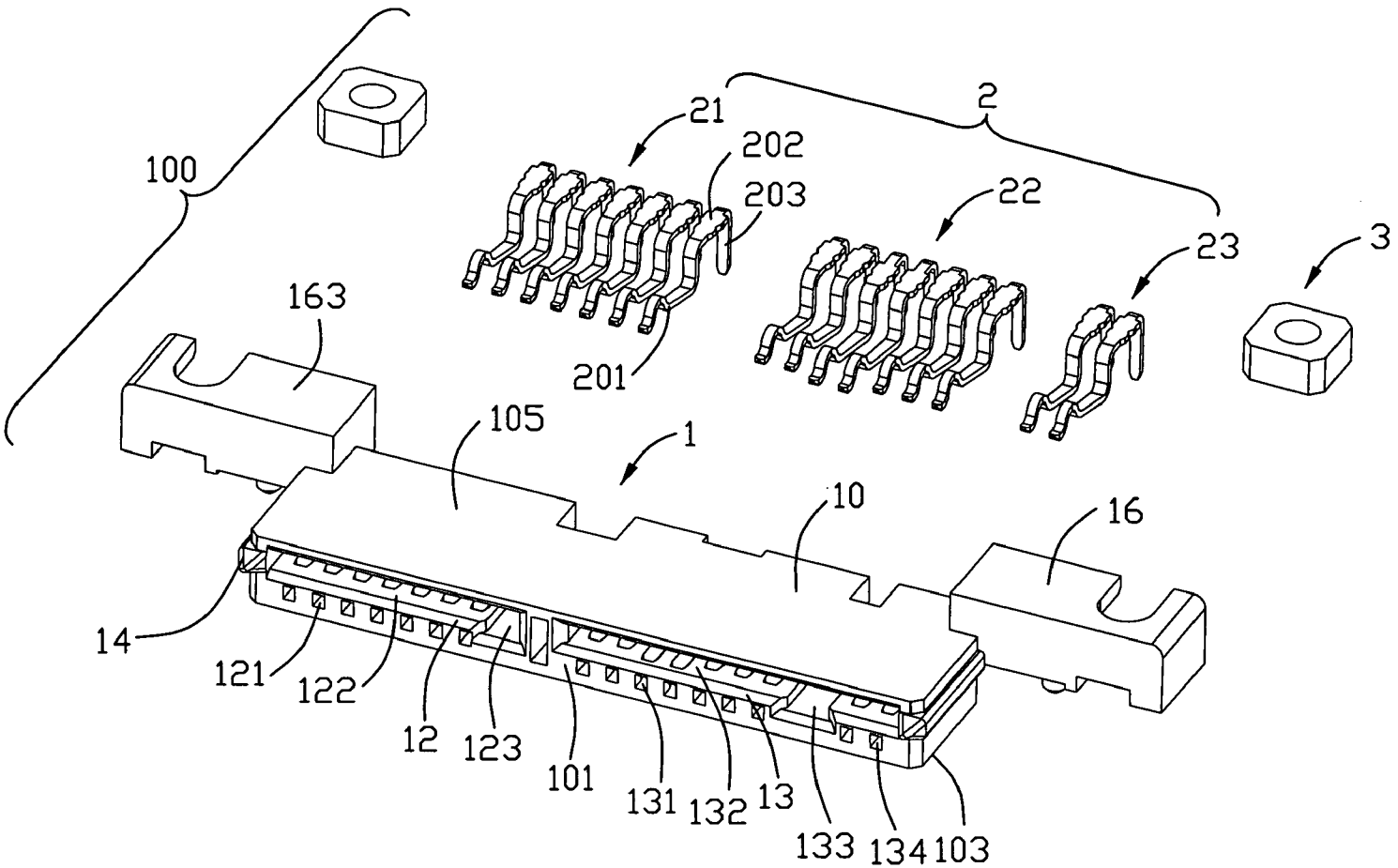
FIG. 2 is an exploded, perspective view of an electrical connector according to the present invention.
Figure 3:
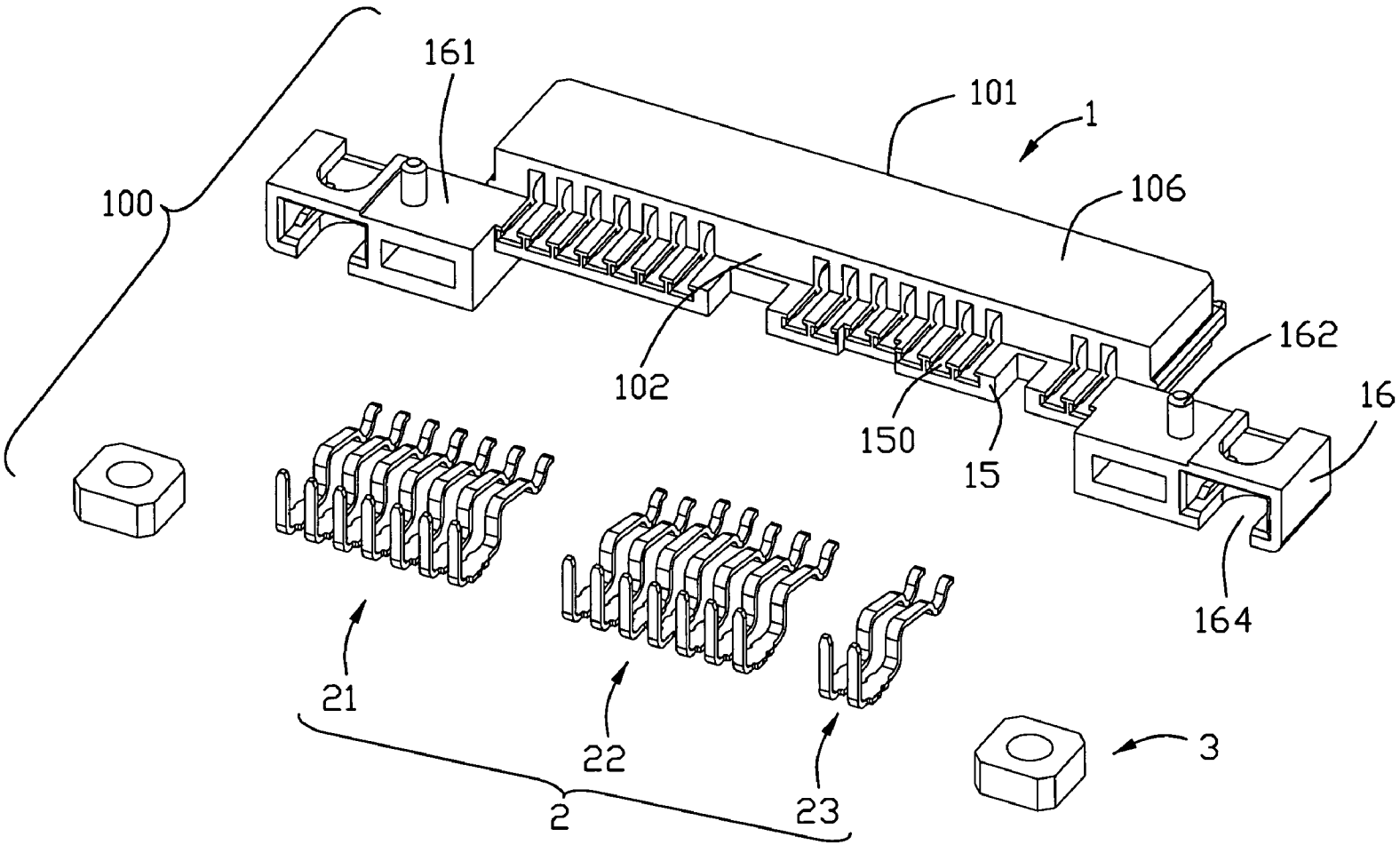
FIG. 3 is a view similar to FIG. 2, but viewed from another aspect.
Figure 4:
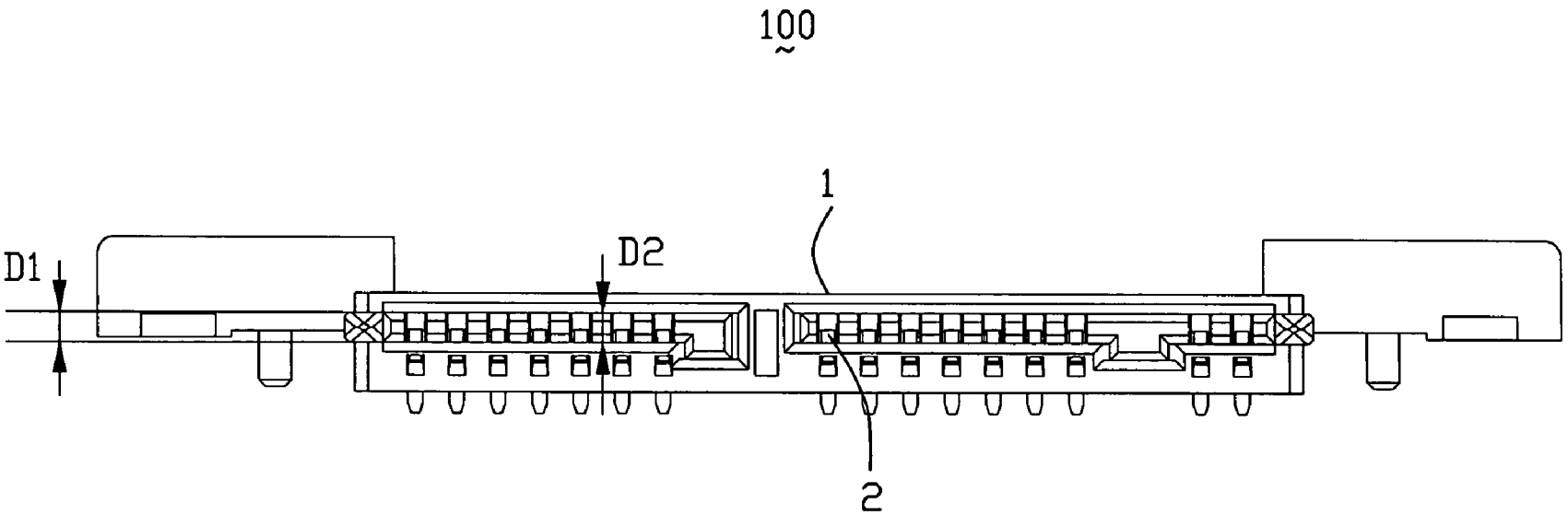
FIG. 4 is a front elevational view of FIG. 1.

Referring to FIGS. 1-4, an electrical connector 100 according to the present invention is adapted for electrically connecting a complementary connector (not shown) and a print circuit board (not shown). The electrical connector 100 comprises an insulative housing 1, a plurality of terminals 2 received in the insulative housing 1 and a pair of retaining members 4 assembled with the insulative housing 1.

The insulative housing 1 comprises an elongated mating portion 10 and a pair of mounting platforms 16 located at two sides of the mating portion 10. The mating portion 10 defines a mating face 101, rear face 102 opposite to the mating face 101, a pair of side walls 103, an upper wall 105 and a bottom wall 106 opposite to the upper wall 105. In the preferred embodiment, the rear face 102 is as the rear direction, and the mating face 101 is as the front direction.

To meet the needs of the signal transmission, the mating portion 10 defines a first receiving port 12 and a second receiving port 13 adjacent to the first receiving port 12 at the mating face 101 of the mating face 101. The first receiving port 12 defines a plurality of receiving slots 121 communicating with the rear face 102 and the mating face 101, a first inserting slot 122 communicating with the first receiving slots 121 and a first positioning groove 123 communicating with and perpendicular to the first inserting slot 122. The first inserting slot 122 and the first positioning groove 123 together define a L-shaped receiving channel (not labeled). The second receiving port 13 defines a plurality of second receiving slots 131 and third receiving slots 134 respectively communicating with the rear face 102 and the mating face 103, a second inserting slot 132 communicating with the second receiving slots 131 and the third receiving slots 134 and a second positioning groove 133 communicating with the second inserting slot 132. The second positioning groove 133 is disposed between the second receiving slots 131 and the third receiving slots 134, and together forms a T-shaped receiving channel (not labeled) with the second inserting slot 132. The mating portion 10 has a pair of guiding posts 14 respectively disposed at two sides thereof and a plate 15 extending rearwardly from the upper wall 105 with a plurality of retaining slots 150 corresponding to the first, second and third receiving slots (121, 131, 134). The pair of guiding posts 14 are symmetrically located at two sides of the first inserting slot 122 and the second inserting slot 132 with the height (D1) not larger than the height (D2) of the first inserting slot 122 and the second inserting slot 132. It means that the guiding posts 14 are located within the boundary of the D2. In the preferred embodiment, the height D1 of the guiding posts are about equal to the height D2.

Each mounting platform 16 defines a mounting face 161 adapting for a print circuit board (not labeled), a upper face 163 opposite to the mounting face 161, a retaining post 162 extending downwardly from the mounting face 161 and a receiving chamber 164 accommodating a retaining member 3. The mounting face 161 is coplanar with the under face of the plate 15 and higher than that of the bottom wall 106 of the mating portion 10. The upper face 163 is above the upper wall 105 of the mating portion 10. This type design is facilitate decreasing the total height of the connector.

The terminals 2 comprise a plurality of first terminals 21 received in the first receiving port 12 and a plurality of second and third terminals 22, 23 received in the second receiving port 13. The first, second and third terminals 21, 22, 23 are of substantial same shape, and each comprises a contacting portion 201, a retaining portion 202 extending rearwardly and upwardly from the contacting portion 201 and a tail portion 203 extending downwardly from the retaining portion 202. The first terminals 21 are assembled into the first receiving slots 121 of the first receiving port 12. The second and third terminals 22, 23 are respectively assembled into the second receiving slots 131 and the third receiving slots 234 of the second receiving port 13 with the contacting portions 201 of the terminals 2 respectively received in the receiving slots (121, 131, 134) and exposed within the first inserting slot 122 and the second inserting slot 132, the retaining portions 202 retained in the retaining slots 150 and the tail portions 203 electrically connecting with a print circuit board.

The electrical connector 1 can maintain the total height of a complementary connector with the pair guiding posts 14 disposed within the spectrum of the height (D2) of the inserting slot (122, 132). Accordingly, the total cost is decreased.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining an inserting slot extending in a longitudinal direction, a plurality of receiving slots arranged along the longitudinal direction and communicating with the inserting slot in a height direction perpendicular to the longitudinal direction, the inserting slot comprising an inserting portion disposed with said plurality of receiving slots and a positioning portion without any receiving slots; and a plurality of terminals received in said receiving slots of the insulative housing;

a pair of guiding posts respectively and symmetrically disposed at two ends of the insulative housing along the longitudinal direction;

wherein the pair of guiding posts are aligned with the inserting portion of the inserting slot in the longitudinal direction and located within the spectrum of the inserting portion of the inserting slot in the height direction.

2. The electrical connector as claimed in claim 1, wherein the position portion of the inserting slot is larger than the inserting portion of the inserting slot in the height direction.

3. The electrical connector as claimed in claim 2, wherein the insulative housing comprising two said inserting slots spaced from each other in the longitudinal direction.

4. The electrical connector as claimed in claim 3, wherein the position portion of one of said two inserting slots is disposed at one end of corresponding inserting portion while the position portion of the other of said two inserting slot is disposed at a middle portion of corresponding inserting portion of the other one.

5. The electrical connector as described in claim 1, wherein the insulative housing comprises a pair of mounting platforms at two rear ends thereof, the mounting platform has a mounting face coplanar with the lower surface of the plate.

6. The electrical connector as claimed in claim 5, wherein the mounting face of the mounting platform is above the bottom wall of the mating portion.

7. An electrical connector comprising:

an insulative housing defining a reverse L-shaped inserting slot with a first inner face and a second inner face parallel to the first inner face, a shorter distance being defined between the first inner face and the second inner face;

a plurality of terminals arranged at the first inner face of the inserting slot and projecting into the inserting slot; and a pair of guiding posts respectively and symmetrically disposed at two ends of the insulative housing and defining a first outer face and a second outer face;

wherein the outer first face and the outer second face of the guiding posts are located within a vertical boundary defined by the first inner face and the second inner face of the inserting slot with said shorter distance therebetween.

8. The electrical connector as claimed in claim 7, wherein contacting portions of the terminals are disposed at said position.

9. An electrical connector comprising:

an elongated rectangular insulative housing for horizontally mounting to a printed circuit board, including opposite first and second longitudinal walls extending in a longitudinal direction, and opposite first and second side walls extending in a vertical direction perpendicular to said longitudinal direction, said first and second longitudinal walls and said first and second side walls commonly defining a horizontal tongue inserting slot in said housing, said first longitudinal wall being thicker than the second longitudinal wall in said vertical direction;

a plurality of receiving slots defined in the first longitudinal wall and extending along a front-to-back direction perpendicular to both said longitudinal direction and said vertical direction, and communicating with the tongue inserting slot in said vertical direction;

a plurality of terminals disposed in the housing, each of said terminals including a deflectable contacting arm disposed in the corresponding receiving slot with contacting apex extending into the tongue inserting slot in said vertical direction; and a pair of guiding posts located intimately and unitarily outside of said first and second side walls, respectively, and extending in said front-to-back direction; wherein each of said pair of guiding posts is not positioned at a middle level of the corresponding side wall in said vertical direction but essentially aligned with the tongue inserting slot in said longitudinal direction.

10. The electrical connector as claimed in claim 9, wherein said first longitudinal wall is located under said second longitudinal wall in said vertical direction.

11. The electrical connector as claimed in claim 9, wherein said tongue inserting slot is dimensioned with a first height in said vertical direction, which is adapted to receive a mating tongue of a complementary connector, and each of the guiding posts is dimensioned with a second height in said vertical direction, said first height being essentially equal to said second height.

12. The electrical connector as claimed in claim 9, wherein each of said guiding posts defines a cone section at a front end, said cone section defining a rectangular shape in a front view, and a peak of said cone section being overlapped with the corresponding side wall in said front view.

* * * * *